United States Patent [19]

Golobay

[11] 4,087,982

[45] May 9, 1978

[54] VIBRATORY PLOW

[75] Inventor: Gary L. Golobay, Valley Center, Kans.

[73] Assignee: J. I. Case Company, Racine, Wis.

[21] Appl. No.: 726,741

[22] Filed: Sep. 23, 1976

[51] Int. Cl.[2] ..... F16L 1/00

[52] U.S. Cl. ..... 61/72.6; 37/193; 74/87; 172/40

[58] Field of Search ..... 61/72.6, 72.4; 37/193, 37/DIG. 18; 172/40, 699; 74/86, 61

[56] References Cited

U.S. PATENT DOCUMENTS

| | | | |
|---|---|---|---|
| 2,974,536 | 3/1961 | Yorgiadis | 74/61 |
| 3,000,278 | 9/1961 | Kaltenegger | 74/61 X |
| 3,233,474 | 2/1966 | Ross et al. | 74/87 |
| 3,363,423 | 1/1968 | Davis | 61/72.6 |
| 3,396,804 | 8/1968 | Rogers | 172/40 |
| 3,528,302 | 9/1970 | Kinnan | 74/87 |
| 3,618,237 | 11/1971 | Davis | 61/72.6 X |
| 3,875,811 | 4/1975 | Fuller | 74/61 |
| 3,935,712 | 2/1976 | Erickson et al. | 61/72.6 |
| 3,948,109 | 4/1976 | Elonen | 74/61 |
| 3,948,329 | 4/1976 | Cummings | 61/72.6 X |

FOREIGN PATENT DOCUMENTS

| | | | |
|---|---|---|---|
| 900,822 | 7/1962 | United Kingdom | 61/72.6 |

*Primary Examiner*—Dennis L. Taylor
*Attorney, Agent, or Firm*—Cullen, Settle, Sloman & Cantor

[57] ABSTRACT

A vibratory plow suitable for laying flexible cable, pipe and the like underground. The vibratory plow assembly includes a frame which supports the assembly on a tractor, bulldozer or other vehicle, a vibrator and a plow. The vibrator includes a housing and a rotating eccentric weight assembly which imparts an oscillatory motion to the vibrator housing about a neutral axis having a varying and reversing moment. The vibrator is supported on the frame by resilient bearings in the neutral axis of the vibrator and the plow is supported on the vibrator housing spaced from the neutral axis to impart vertical vibration to the blade. The first embodiment includes a blade on each side of the neutral axis, such that the blades are vibrated in opposite directions to impart a shearing action. In the second embodiment, only one blade is utilized and a counterweight is supported on the vibrator housing to counterbalance the blade. The preferred embodiment of the vibrator utilizes two weights rotating in the same direction 180 degrees out of phase and a pair of amplitude adjustment weights supported on the vibrator housing equidistant from the neutral axis.

17 Claims, 11 Drawing Figures

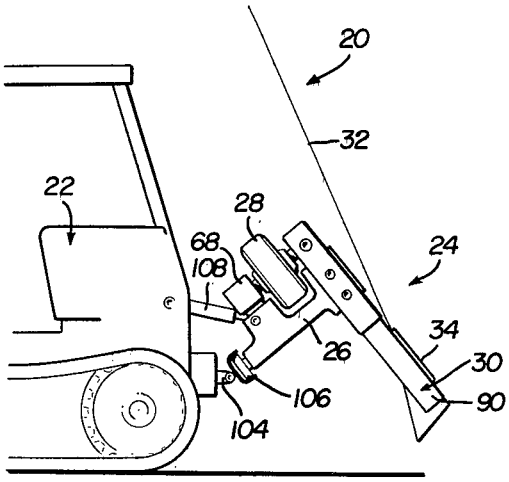
FIG. 1
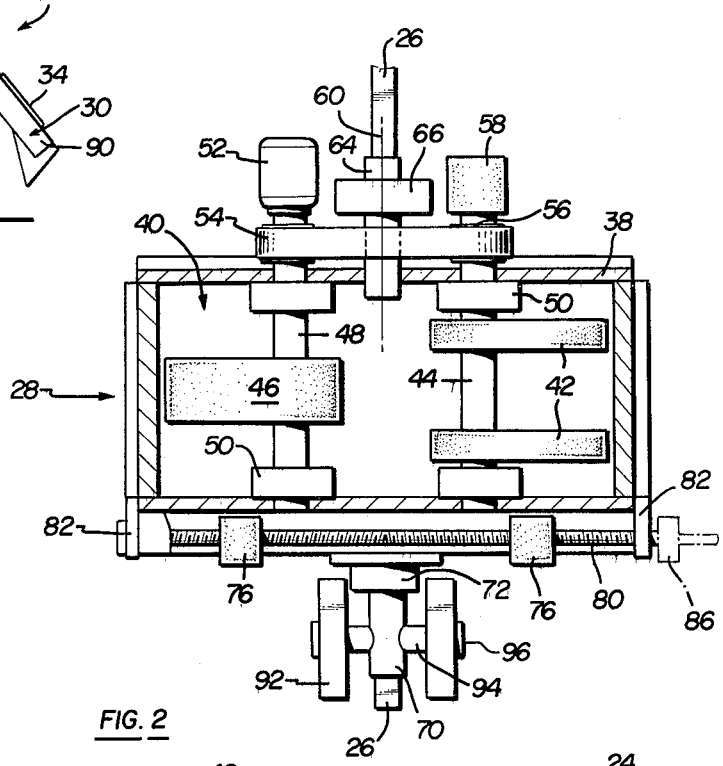
FIG. 4
FIG. 3
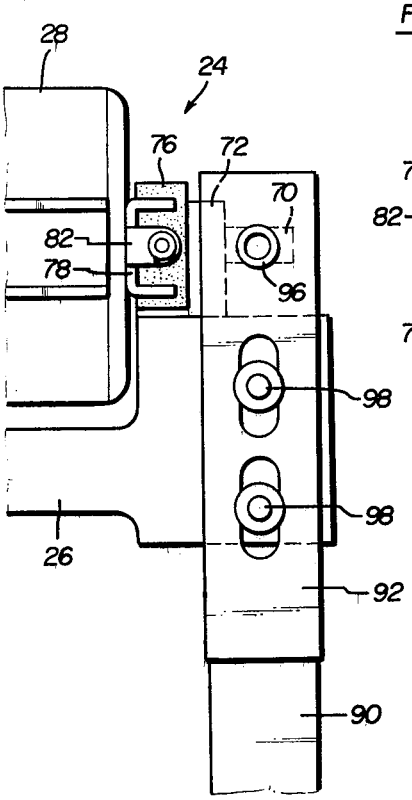
FIG. 2
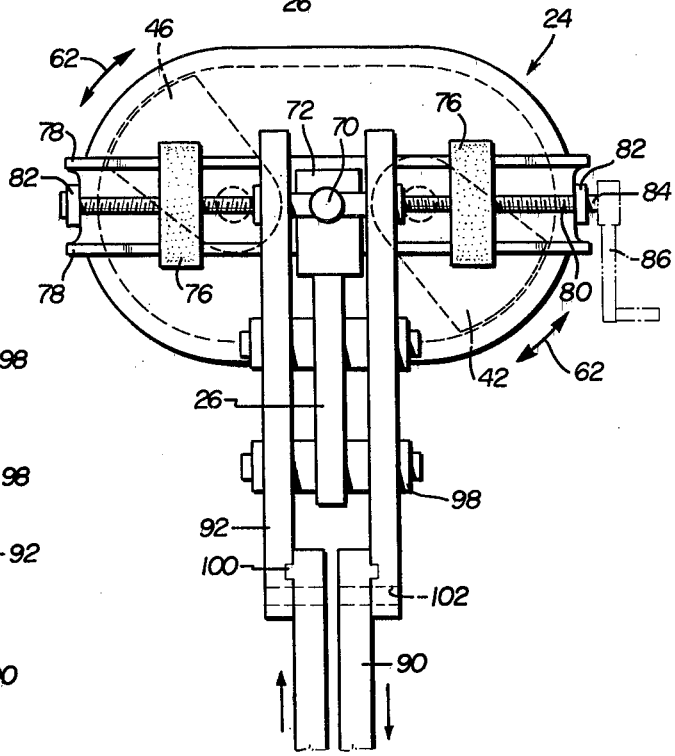

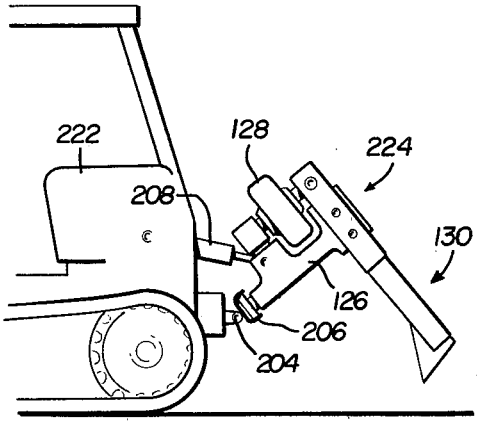
FIG. 8
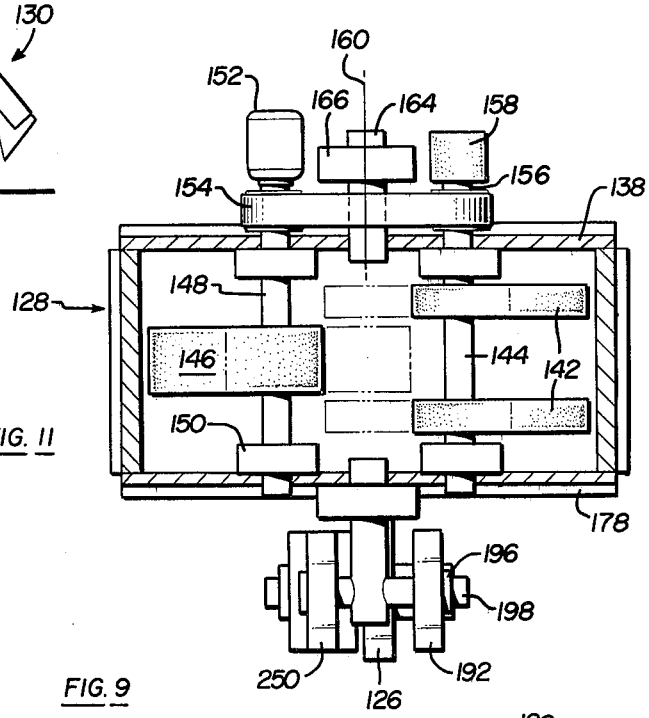
FIG. 11
FIG. 10
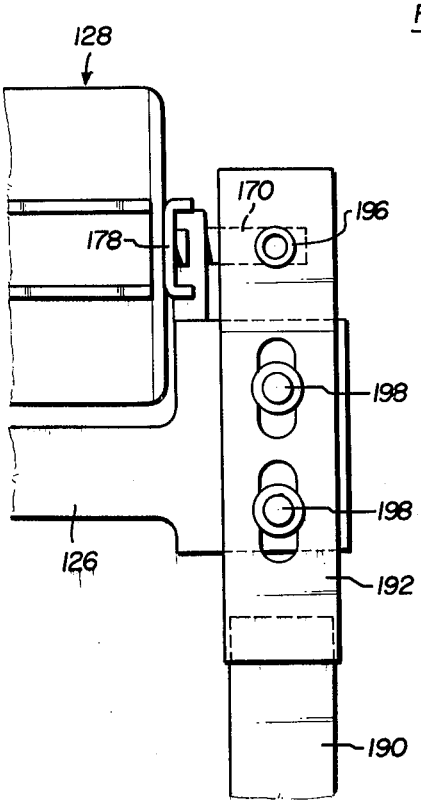
FIG. 9
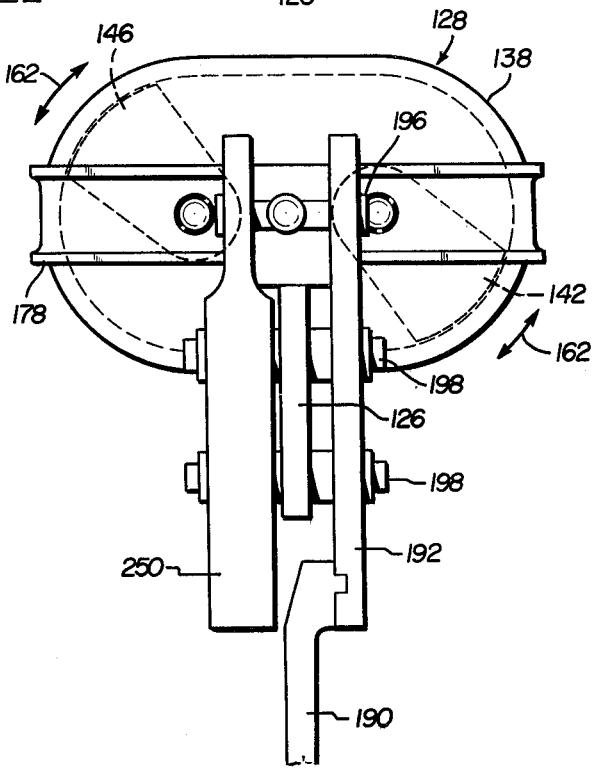

VIBRATORY PLOW

FIELD OF THE INVENTION

The disclosed invention relates generally to a plow which is vibrated to reduce the drawbar pull and limit ground disturbance. The vibratory plow of this invention may be utilized to lay a continuous length of flexible cable, pipe, etc. underground at a desired depth. More particularly, this invention relates to a vibratory plow wherein the blade or blades are supported on an oscillating vibrator.

DESCRIPTION OF THE PRIOR ART

Plows of the type disclosed herein having an elongated vertical blade have been utilized for several years to lay cable, flexible pipe, etc. The cable or pipe may either be pulled through the cut of the plow blade or a cable chute may be provided on the trailing edge of the blade which guides the cable into the ground from a drum mounted on the prime mover. More recently, various types of vibrators have been mounted on the plow blade or the supporting frame which effectively reduces the drawbar pull or force required to pull the blade through the ground, such as disclosed in U.S. Pat. No. 3,363,423. For the same reason, vibration has been utilized in other plow applications, including rippers, etc. Vibration of the blade of a cable laying plow has also resulted in other advantages, including less ground disturbance, faster cable laying installation, etc.

Following the development of vibratory cable laying plows, several improvements have been made particularly relating to isolation of the vibrating blade. For example, U.S. Pat. No. 3,618,237 discloses a unique frame support for a cable laying plow having torque cushioning elements which absorb the reciprocable motion of the support and substantially isolate the frame from the supporting structure. The vibrator or shaker includes two eccentrically mounted weights which rotate in opposite directions to impart vertical vibration to the shaker. The eccentric weights are mounted on parallel shafts. One shaft is driven by a motor and the opposed shaft is driven in the opposite direction by a gearing arrangement. The gear drive is relatively expensive and results in noise and heat and requires maintenance. Further, the vibrator or shaker must be isolated from the tractor or prime mover, requiring a relatively complex, expensive frame support. The vibratory plow of the present invention eliminates the gearing, noise and maintenance by a simple belt drive which rotates the weights in the same direction, 180° out of phase. Further, the unique motion of the shaker permits the use of two blades vibrating in opposite directions to provide a shearing action to the blades as described below.

As stated, an important advantage of vibratory plows is the reduction in drawbar pull, however in wet gumbo or soil containing heavy sod or roots, a vibratory plow has difficulty because the soil tends to wrap around the blade and follow its vibrating motion. Where the plow can not shear the mass, the plow must be lifted over the obstruction and reset. Various types of vibratory or oscilatory motions have been suggested, as shown in U.S. Pat. Nos. 3,326,009 and 3,326,010. The utilization of two or more blades reciprocating in an orbital motion has also been suggested by German Pat. No. 629,544 (1936). The blades are reciprocated by a positive worm-/gear drive. Positive drive means however have not been successful commercially because the drive or blades are damaged when an obstruction is engaged.

The vibratory plow of the present invention elminates the problems with the prior art by providing an impositive shaker drive for the blade or blades which is relatively simple and inexpensive in construction and which eliminates the requirement for a complex frame assembly to isolate the vibrator or shaker from the prime mover. Further, two blades may be utilized which provides a shearing action, permitting the blade to pass through wet and heavy soil and soil containing roots and other obstructions.

SUMMARY OF THE INVENTION

The vibratory plow of this invention includes a prime mover or vehicle, such as a conventional tractor or bulldozer, a generally vertical elongated plow blade, a frame assembly which supports the blade on the vehicle and a vibrator or shaker which is supported on the frame assembly. Where the vibratory plow of this invention is utilized as a cable laying plow, the assembly also includes a cable chute on the trailing edge of the blade which receives and guides the cable into the slit cut by the plow blade. It will be understood that the vibratory cable laying plow may be utilized to lay any flexible elongated element in the ground, including flexible pipe, electrical cables and the like.

The vibratory plow assembly of the present invention includes a simple frame which may be connected directly to the prime mover, a vibrator or shaker and a blade which is supported on the vibrator housing. The vibrator includes a rotating weight assembly which results in oscillating motion of the vibrator housing about a neutral axis. The vibrator is supported on the frame by resilient bushings which permit the vibrator to oscillate and the blade is supported on the vibrator housing, spaced from the neutral axis, resulting in generally vertical vibration of the blade. Where one blade is utilized, a counterweight is supported on the vibrator housing on the opposed side of the neutral axis, counterbalancing the blade. Where two blades are used to impart a shearing action as described above, the blades are supported on the vibrator housing on opposed sides of the neutral axis, preferably equidistant from the neutral axis. The blades are thus vibrated in opposite directions to impart a shearing action to the soil.

The preferred vibrator or shaker includes a pair of weights eccentrically mounted on parallel shafts within the vibrator housing. The weights are driven in the same direction, 180° out of phase by a simple belt drive, imparting an oscillating motion to the vibrator housing having a varying and reversing moment about the neutral axis. The amplitude of the oscillatory motion may be adjusted by a pair of weights supported on the vibrator housing equidistant from the neutral axis and an adjustment means is provided to vary the distance between the amplitude adjustment weights and the neutral axis of the vibrator to adjust the amplitude of the oscillating motion.

The vibratory plow assembly is therefore relatively simple in construction and results in several advantages over the prior art. The frame for example, may be a single plate having resilient bushings which receive the vibrator or shaker with the neutral axis in the plane of the frame plate. The vibrator may be driven by a motor and belt drive because the weights are driven in the same direction, thus eliminating costly gears and castings, as well as limiting noise, heat and maintenance.

Isolation of the vibrator from the prime mover is not required since all acceleration forces within the vibrator are equal and opposite, providing greater operator comfort and a low noise level.

Other advantages and meritorous features of the vibratory plow and unique vibrator or shaker assembly will be more fully understood from the following description of the preferred embodiments, the appended claims and the drawings, a brief description of which follows.

BRIEF DESCRIPTION OF THE DRAWINGS

FIG. 1 is a partial side elevation of one embodiment of the cable laying plow of this invention;

FIG. 2 is a rear view of the vibratory plow assembly shown in FIG. 1;

FIG. 3 is an enlarged partial side view of the vibratory plow, illustrating the blade support;

FIG. 4 is a top view, partially cross sectioned, of one embodiment of the preferred vibrator or shaker;

FIG. 8 is a side elevation, similar to FIG. 1, illustrating another embodiment of the vibratory plow of this invention;

FIG. 9 is a rear view of the vibratory plow shown in FIG. 8;

FIG. 10 is an enlarged side elevation of the blade assembly shown in FIGS. 8 and 9; and FIG. 11 is a partially cross sectioned top elevation of the vibrator or shaker shown in FIG. 9.

DESCRIPTION OF THE PREFERRED EMBODIMENTS

Figure 7:
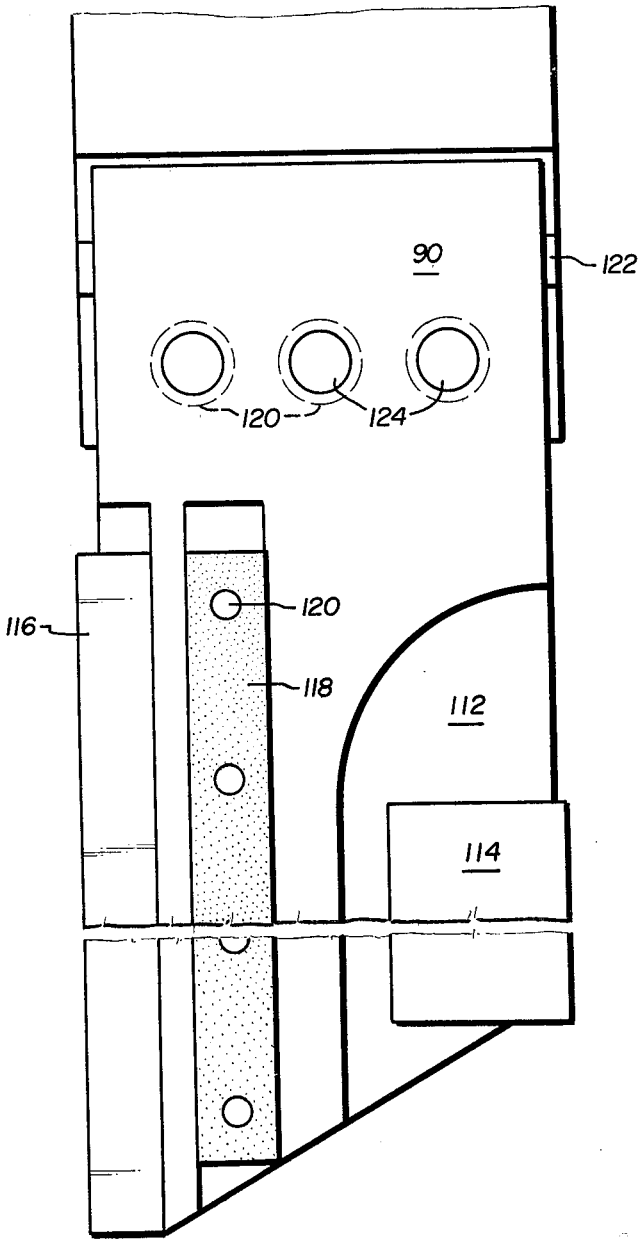
FIG. 7 is a partial side view of one blade of the assembly shown in FIG. 5.

The embodiment of the cable-laying plow shown in FIGS. 1 to 4 includes a prime mover 22 and a vibratory plow assembly 24. It will be understood that the prime mover may be any suitable vehicle, including bulldozers, tractors and the like. The vibratory plow assembly generally includes a frame 26, a vibrator or shaker 28 and a plow assembly 30. As described, the plow of this invention may be utilized to lay cable, flexible pipe or hose underground. In a conventional application, the cable is supported on a drum at the forward end of the prime mover, not shown. The cable 32 is then received over suitable reels to the cable chute 34 on the rearward end of the plow assembly as described more fully hereinbelow. Reference is also made to U.S. Pat. No. 3,618,237 referred to above.

The preferred embodiment of the vibrator 28 is best shown in FIG. 4. The vibrator includes a housing 38 and a pair of weights 40 eccentrically mounted for rotation within the housing. In the disclosed embodiment, one weight 42 is split and mounted in spaced relation on the shaft 44 and the opposed weight 46 is mounted near the center of shaft 48 such that weight 46 will pass between the halves of weight 42 as shown in FIG. 4. The shaft 44 and 48 are mounted in suitable bearings 50, such as roller bearings, to permit free rotation of the weights 42 and 46. Shaft 48 is driven by motor 52 and shaft 44 is driven in the same rotational direction by belt 54 which is received on suitable collers 56 on the shafts. In the preferred embodiment, a counterweight 58 is provided to counterbalance the mass of the motor 52.

A similar shaker assembly is disclosed in U.S. Pat. Nos. 1,999,213, 2,097,347, and 2,178,813, except that the weights are driven by gears in opposite directions to impart vibration in a single plane or line. For example, the weights may be timed to provide vertical vibration in a cable laying plow. The problems inherent in a shaker having oppositely rotating weights has already been described. In the preferred embodiment of the vibrator or shaker of this invention, the weights rotate in the same direction, 180° out of phase. As described, this allows the weights to be belt driven, thus eliminating costly gears and limiting noise, heat and maintenance. Where the weights are timed as described, the vibrator oscillates about a central or neutral axis 60 with a varying and reversing moment as shown by arrows 62 in FIG. 2. The shaker oscillates from a maximum clockwise moment to zero moment and reversing to a maximum counter clockwise moment to zero moment as the weights rotate about their respective axes. This varying and reversing oscillation is then utilized to vibrate the plow blades generally vertically as described hereinbelow.

The vibrator 28 is mounted on the frame 26 in the neutral axis 60 to permit oscillation of the vibrator. The vibrator includes a support shaft on opposed sides of the vibrator coaxially aligned with the neutral axis. The input shaft 64 includes a resilient bushing 66 which is secured to the forward end 68 of the frame 26 as shown in FIG. 1 and the output shaft 70 includes a resilient bushing 72 which is mounted on the rearward end of the frame 26. Rotation of the weights 42 and 46 thus results in the oscillatory motion described above.

The preferred embodiment of the shaker also includes an amplitude adjustment mechanism as shown in FIGS. 2 to 4. A pair of weights having equal mass are adjustably supported on the shaker housing equidistant from the neutral axis 60. In the disclosed embodiment, the shaker housing includes a channel 78 which slidably receives the weights as best shown in FIG. 3. The weights each include a threaded bore which receives threaded adjustment rod 80. The bores of the weights 76 are oppositely threaded to maintain the weights equidistant from the neutral axis as the rod 80 is turned. The rod 80 is rotatably supported on end brackets 82 and the rod includes a flat end portion 84 which may receive a crank handle 86 as shown in FIGS. 2 and 4. Rotation of the crank handle 86 thus rotates rod 80 to adjust the distance between amplitude adjustment weights 76 and the neutral axis. These weights change the shaker's rotational inertia as they are moved, thereby changing the shaker's natural frequency, resulting in a change in the amplitude of oscillation. As the weights are moved outwardly from the neutral axis, the amplitude of oscillation is decreased. The adjustment of the amplitude of oscillation of the shaker also results in an adjustment of the amplitude of vertical vibration of the plow blades.

Plow blades 90 are supported on the vibrator as described below. Blade mounting plates 92 are supported on the output shaft 70 of the vibrator by shaft 94 and spherical bushings 96 and the plates are connected to the rigid frame by needle bearing rollers 98. The outer race of the spherical bushings must be free to slide within the support bracket to prevent binding. The blades 90 are then connected to the blade support plates 92 by a tongue and groove joint 100 as shown in FIG. 2 and by bolts 102. It will be understood that the cable guide 34 in FIG. 1 has not been shown in FIGS. 2 to 4 to more clearly illustrate the structure of the assembly.

The operation of the vibratory plow assembly shown in FIGS. 1 to 4 is then as follows. Motor 52 and belt drive 54 rotate weights 42 and 46 in the same direction, 180° out of phase. This rotation of the vibrator weights results in oscillation of the vibrator about neutral axis 60 with a varying and reversing moment. The blades 90 and support plates 92 are supported on the vibrator housing on output shaft 70 on opposed sides of the neutral axis, resulting in opposite vibration of the blades. That is, one blade is moving upwardly as the opposed blade is moving downwardly. With the two blades 90 moving in opposite directions, any material in contact with the blade will be pulled tight across the leading edges of the blade and then drawn downwardly by one blade and simultaneously upwardly by the opposed blade. This results in a shearing action which is very desirable in a plow, particularly in a cable laying plow. In the disclosed embodiment, the frame 26 is supported on the hitch 104 of the prime mover by a drawbar pivot 106. The upper edge of the frame is connected by hydraulic cylinder 108 to the prime mover as shown in FIG. 1, such that the blade assembly may be tipped upwardly as shown in FIG. 1 by retracting cylinder 108. The blade 90 may be lowered into the soil by operating motor 52 which transmits vertical vibrations to plow blades 90. The cylinder 108 is then extended and the blades cut into the soil as the blade is lowered. The prime mover 22 is then moved forwardly and the cable 32 is disposed in the slot cut by the blades.

Figure 5:
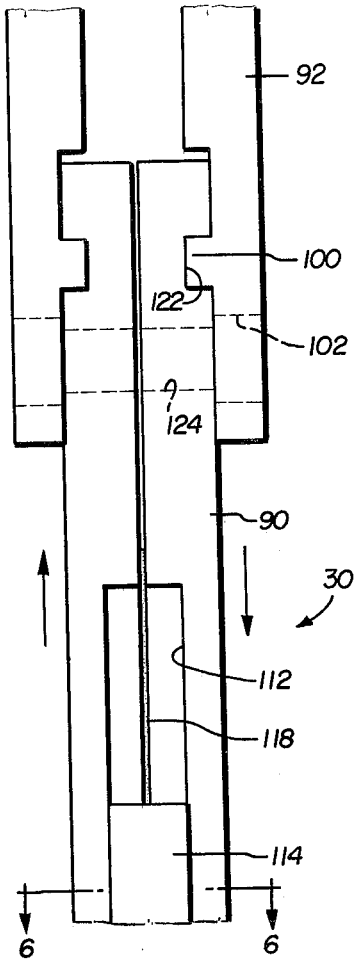
FIG. 5 is a partial rear view of one embodiment of the double blade assembly shown in FIGS. 1 to 4.
Figure 6:
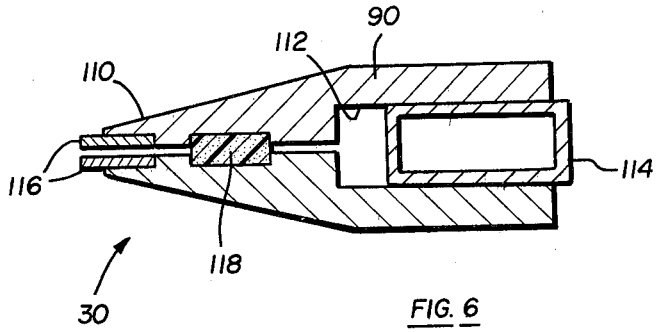
FIG. 6 is a cross-sectional view of the blade assembly shown in FIG. 5, in the direction of view arrows 6—6.

A suitable embodiment of the blade assembly 30 is shown in FIGS. 5 to 7. In this embodiment, the blades are supported in bearing relation to prevent separation of the blades in the soil. The blades are each tapered at the forward or leading edge 110 as shown in FIG. 6. Each blade includes a channel 112 which receives the cable guide 114 as shown in FIGS. 5 and 6. The blades each include a carbide insert 116 which is received in a slot at the forward edge of the blade and brazed or otherwise secured in place. A bearing insert 118 is provided between the blades to provide bearing contact. The bearing material is preferably a fluorinated hydrocarbon, such as Delrin which is rivited, bolted or otherwise secured in place as shown at 120. The carbide insert limits damage to the blade when the blade engages an obstacle in the soil and the bearing insert 118 prevents damage to the blades as the blades are moved in opposite directions in bearing contact. The cable is received in cable guide 114 and guided from guide channel 34 as shown in FIG. 1 to the lower edge of the blade. As described above, the blades 90 are connected to support plates 92 by a tongue and groove joint 100 and bolts 102. The blades each include a notch 122 which receives the tongue of the support plates 92 and an aperture 124 which may be threaded to receive the mounting bolts.

FIGS. 8 to 11 illustrate another embodiment of the vibratory plow of this invention. As described, the assembly includes a prime mover 222 and a vibratory plow assembly 224 including a frame 126, vibrator 128 and plow assembly 130. It will be seen that the reference characters, where possible, are in the same sequence as FIGS. 1 to 4.

The vibrator 128 includes a frame 138 having a pair of rotatable eccentrically mounted weights 142 and 146. As described above, motor 152 and belt drive 154 will rotate weights 142 and 146 in the same direction, 180° out of phase, to oscillate the vibrator housing with a varying and reversing moment. The vibrator is mounted on frame 126 as described above by resilient bushings 166 and 172 on input shaft 164 and output shaft 170, respectively. The vibrator is thus permitted to oscillate as described above.

This embodiment of the vibratory plow utilizes only one blade 190 which is mounted to the vibrator housing 138 and frame 126 by spherical bushings 196 and needle bearings 198, respectively. Oscillation of the housing thereby results in generally vertical vibration of the blade 190 as described above.

In this embodiment, however, the mass of the blade assembly must be counterbalanced. A large counterweight 250 is therefore supported on the vibrator in a manner similar to the left blade in FIG. 2. The counterweight balances the accelerating forces when moving the single blade 190 and the associated members 192, etc. It will also be noted that the vibratory plow embodiment shown in FIGS. 8 to 11 does not include the amplitude adjustment mechanism of FIGS. 1 to 4. Otherwise, the details of the vibratory plow assembly may be identical to the embodiment disclosed in FIGS. 1 to 4 and has been numbered in the same sequence. The operation of the single blade vibratory plow is substantially as described above. The weights 142 and 146 impart an oscillatory motion to the vibrator housing as shown by arrows 162. The blade support plate 192 is supported on the housing spaced from the neutral axis 160, resulting in vertical vibration of the blade 190.

It will be understood that various modifications may be made to the vibratory plow and shaker of this invention. Although the vibrator embodiments disclosed in FIGS. 4 and 11 are preferred, other vibrators may be utilized provided the vibrator imparts an oscillating motion to the housing as descirbed. Further, other blade configurations may be utilized, such as where the blade is supported directly on the vibrator housing.

I claim:

1. A vibratory plow having a generally vertical elongated blade and a vibrator, said vibrator having a weight rotating within a vibrator housing resulting in oscillating motion of said vibrator housing about a neutral axis, a frame support having resilient bushing means supporting said vibrator in said neutral axis while permitting said vibrator to oscillate about said neutral axis, said blade connected to said vibrator housing spaced from said vibrator neutral axis, said vibrator vibrating said blade in generally vertical oscillating motion and counterweight means supported on said vibrator housing on the opposed side of said neutral axis counterbalancing said blade.

2. The vibratory plow defined in claim 1, characterized in that said counterbalancing means is a second blade supported on said vibrator housing generally parallel to said first mentioned blade and vibrating vertically oppositeto said first blade.

3. The vibratory plow defined in claim 1, characterized in that said blades each include opposed bearing surfaces and said blades supported on said housing in bearing contact, permitting said blades to vibrate vertically in opposite directions.

4. The vibratory plow defined in claim 1, characterized in that said vibrator includes two eccentric weights supported on spaced parallel shafts and a power means rotating said weights in the same direction 180° out of phase.

5. The vibratory plow defined in claim 4, characterized in that one of said weights comprises two eccentric weights spaced on the supporting shaft a distance sufficient to receive the opposed weight, the mass of said two weights being equal to said opposed weight.

6. The vibratory plow defined in claim 4, characterized in that said vibrator includes a support shaft having an axis concentric with said neutral axis of said vibrator and said vibrator being supported by resilient bearings receiving said support shaft and connected to said frame.

7. The vibratory plow defined in claim 1, characterized in that said vibrator housing includes two amplitude adjustment weights supported on said vibrator housing equidistant from said neutral axis and weight adjustment means for adjusting the distance between said amplitude adjustment weights and said neutral axis for adjusting the amplitude of the oscillating motion of said vibratory housing.

8. A vibratory plow assembly, comprising:

a vibrator having a housing, a weight rotating within said housing imparting oscillating motion to said vobrator housing about a neutral axis and a vibrator support shaft on opposed sides of said vibrator housing concentric with said neutral axis, a frame supporting said vibrator support shafts including resilient bushing means mounted on said frame receiving said shafts and permitting said housing to oscillate about said neutral axis and a pair of generally parallel blades mounted on said vibrator housing on opposed sides of said neutral axis, generally equidistant from said neutral axis, said vibrator thereby vibrating said blades in opposite directions in a shearing motion.

9. The vibratory plow defined in claim 8, characterized in that said blades each include an opposed bearing surface and said blades are supported on said vibrator housing in bearing contact.

10. The vibratory plow assembly defined in claim 8, characterized in that said vibrator housing includes two amplitude adjustment weights supported on said vibrator housing equidistant from said neutral axis and a weight adjustment means adjusting the distance between said weights and said vibrator neutral axis for adjusting the amplitude of the oscillating motion of said vibrator housing.

11. The vibratory plow assembly defined in claim 8, characterized in that said vibrator includes two eccentric weights supported on parallel shafts and a power means rotating said weights in the same direction 180° out of phase, said eccentric weights oscillating said housing with a varying and reversing moment.

12. A vibratory plow assembly, comprising:

a vibrator having a housing, a pair of weights eccentrically mounted on parallel shafts within said housing, drive means rotating said weights in the same direction 180° out of phase imparting an oscillating motion to said vibrator housing about a neutral axis parallel to said shafts and a vibrator support means on opposed sides of said vibrator housing concentric with said neutral axis, a blade mounted on said vibrator housing spaced from said neutral axis, rotation of said weights resulting in vibration of said blade and a counterweight means mounted on said vibrator housing spaced from said neutral axis on the opposed side of said blade and counterbalancing said blade.

13. The vibratory plow assembly defined in claim 12, characterized in that said counterbalancing means comprises a second blade generally parallel to said first mentioned blade, vibrating in the opposite direction to said first blade.

14. The vibratory plow defined in claim 12, characterized in that said blade is elongated and generally vertical and said blade includes a cable guide means adapted to guide cable from the upper edge to the bottom of said blade.

15. A vibratory calbe laying plow, comprising:

a frame support, a vibrator having a housing, a vibrating means including an eccentric weight rotating within said housing imparting oscillatory motion to said housing about a neutral axis and a support shaft extending from opposed sides of said housing concentric in said neutral axis, said vibrator supported on said frame by resilient bushings permitting said frame to oscillate in oppoiste directions about said neutral axis, a generally vertical elongated blade supported on said vibratory housing spaced from said neutral axis, a counterbalancing means supported on said vibrator housing spaced from said neutral axis on the opposite side of said blade counterbalancing said blade, power means rotating said vibrator weight imparting oscillatory motion to said vibrator housing and cable guide means on the trailing edge of said blade guiding cable from the upper portion of said blade to the lower edge.

16. The cable laying plow defined in claim 15, characterized in that said counterbalancing means comprises a second blade generally parallel to said first mentioned blade vibrating in the opposite direction from said first blade and said cable guide means is defined between said blades.

17. The cable laying plow defined in claim 16, characterized in that each of said blades includes a bearing surface and said blades are supported in bearing relation and said guide means comprises a channel between said blades.

* * * * *